US007073279B2

(12) United States Patent
Min

(10) Patent No.: US 7,073,279 B2
(45) Date of Patent: Jul. 11, 2006

(54) SHOELACE TIGHTENING STRUCTURE

(76) Inventor: Duck Gi Min, 8235 Stewart and Gray Rd., Apt. 102, Downey, CA (US) 90241

( * ) Notice: Subject to any disclaimer, the term of this patent is extended or adjusted under 35 U.S.C. 154(b) by 184 days.

(21) Appl. No.: 10/889,896

(22) Filed: Jul. 12, 2004

(65) Prior Publication Data

US 2006/0005429 A1 Jan. 12, 2006

(51) Int. Cl.
*A43C 7/00* (2006.01)

(52) U.S. Cl. ..... 36/50.1; D2/978; 24/712

(58) Field of Classification Search ..... 36/50.1, 36/50.5, 51; D2/978; 24/712.1, 712.5
See application file for complete search history.

(56) References Cited

U.S. PATENT DOCUMENTS 4,942,678 A * 7/1990 Gumbert ..... 36/102
5,657,557 A * 8/1997 Hull et al. ..... 36/58.5
6,088,936 A * 7/2000 Bahl ..... 36/50.1
6,128,835 A * 10/2000 Ritter et al. ..... 36/45
6,282,817 B1 * 9/2001 Curet ..... 36/50.1
6,826,851 B1 * 12/2004 Nelson, Jr. ..... 36/50.1
6,952,890 B1 * 10/2005 Blakeslee ..... 36/50.1
2004/0078999 A1 * 4/2004 Freed ..... 36/50.1
2004/0181972 A1 * 9/2004 Csorba ..... 36/50.1

* cited by examiner

*Primary Examiner*—Jila M. Mohandesi
(74) *Attorney, Agent, or Firm*—Hoffmann & Baron, LLP

(57) ABSTRACT

Disclosed herein is a shoelace tightening device for making it easier for the wearer to tie shoelaces of shoelace-type shoes, including sports shoes. The shoelace tightening structure includes a tightening lace, a pair of locking devices, and a shoelace. The tightening lace is successively threaded upward at both ends thereof through first and second row loops arranged in parallel along eyelet lines defined at left and right vamps of a shoe. The locking devices are fixed at opposite side positions above the eyelet lines. Through the locking devices are inserted both the ends of the tightening lace, respectively. The shoelace is tied on the tightening lace as both ends thereof alternately pass through portions of the tightening lace between the respective first row loops, and portions of the tightening lace between the respective second row loops so as to crisscross each other. The shoelace tightening structure of the present invention enables the wearer can easily tighten the shoe to conform closely with the shape of his/her foot by simply pulling the tightening lace, as well as can easily take off the shoe by pushing release buttons of the locking devices to loosen the tightening lace.

1 Claim, 2 Drawing Sheets

SHOELACE TIGHTENING STRUCTURE

TECHNICAL FIELD

The present invention relates to a shoelace tightening structure for making it easier for the wearer to tie shoelaces of shoelace-type shoes, including sports shoes.

BACKGROUND ART

Generally, most widely used sports shoes are designed to enable the wearer to tighten his/her shoe to conform closely with the shape of the wearer's foot by using a shoelace, except for some shoes using velcro-fasteners.

Such shoelace-type shoes, however, have several drawbacks due to the fact that the wearer has to tie or untie the shoelace whenever putting on or taking off the shoe. That is, it is actually impossible to assure the shoelace to be tightened with a constant tension, and the tying or untying action of the shoelace may be difficult for some wearers, and requires a relatively long time. Further, hanging ends of the shoelace, which remain after tying, may result in a low wearing comfort upon fluttering.

DISCLOSURE OF THE INVENTION

Therefore, the present invention has been made in view of the above problems, and it is an object of the present invention to provide a shoelace tightening structure for making it easier for the wearer to tie shoelaces of shoelace-type shoes, including sports shoes.

In accordance with the present invention, the above and other objects can be accomplished by the provision of a shoelace tightening structure comprising: a tightening lace, which is successively threaded upward at both ends thereof through first and second row loops arranged in parallel along eyelet lines defined at left and right vamps of a shoe; a pair of locking devices fixed at opposite side positions above the eyelet lines, through the locking devices being inserted both the ends of the tightening lace, respectively; and a shoelace, which is tied on the tightening lace as both ends thereof alternately pass through portions of the tightening lace between the respective first row loops, and portions of the tightening lace between the respective second row loops so as to crisscross each other.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be explained in detail with reference to the accompanying drawings.

Figure 1:
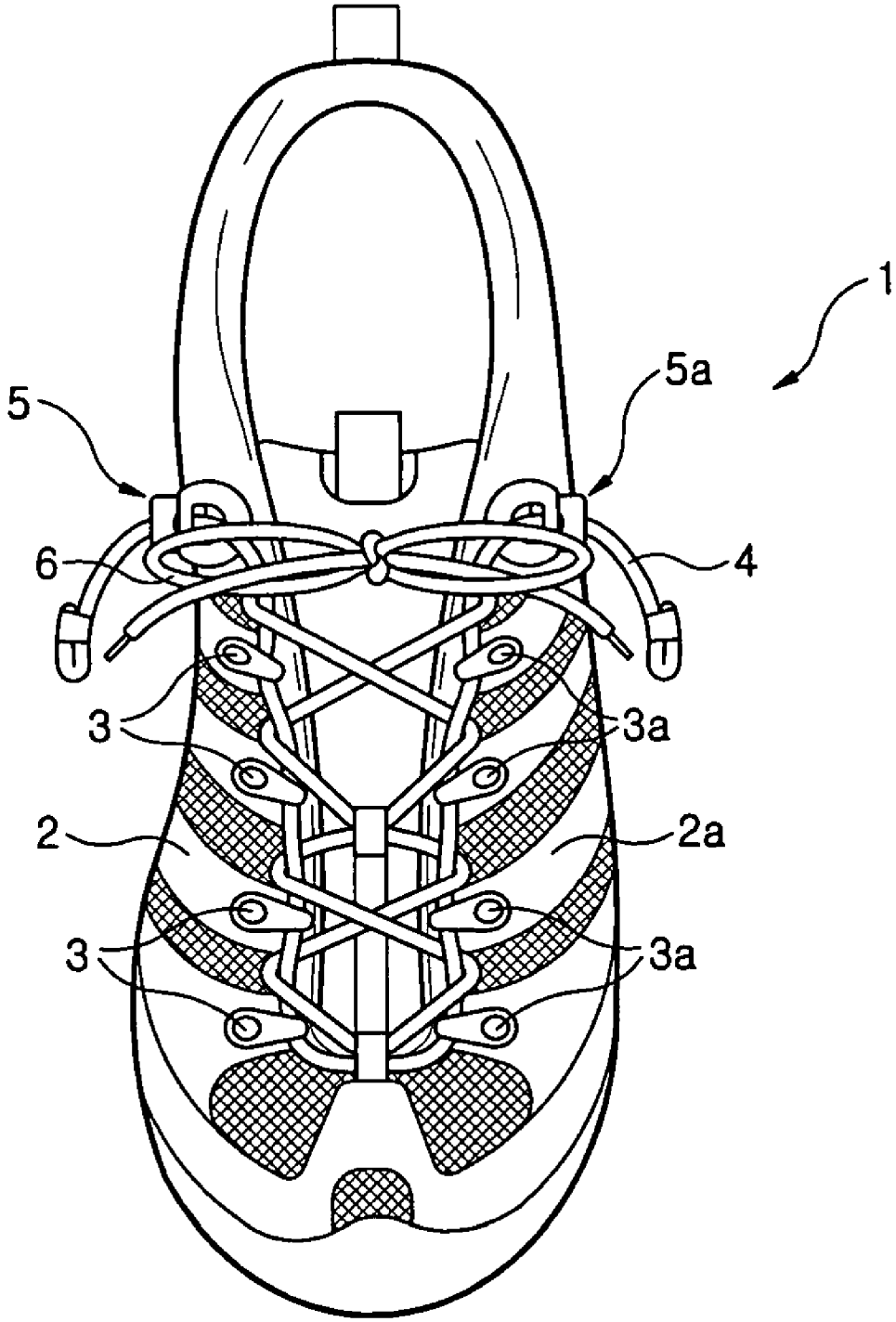
FIG. 1 is a perspective view illustrating a taut tied state of a tightening lace using a shoelace tightening structure in accordance with the present invention.
Figure 2:
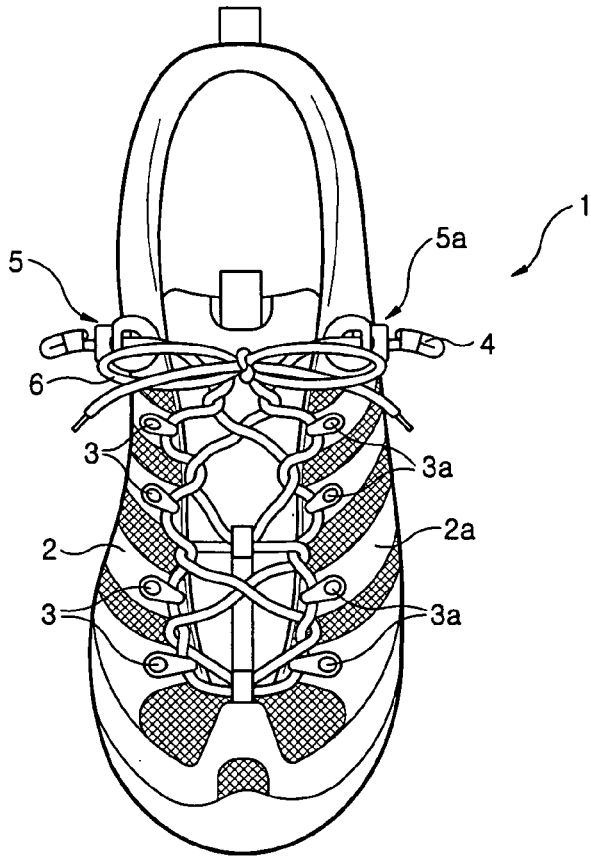
FIG. 2 is a perspective view illustrating a loosely tied state of the tightening lace using the shoelace tightening structure in accordance with the present invention.

Referring to FIG. 1, a shoe 1, adopted in the present invention, is designed in such a fashion that two eyelet lines

2 and 2*a* are defined at left and right vamps, respectively, and a plurality of first and second row loops 3 and 3*a* are arranged along the eyelet lines 2 and 2*a* so that a tightening lace 4 is threaded therethrough. Here, the first row loops 3 and the second row loops 3 are symmetrically arranged in parallel to each other. At a portion, where lower ends of the eyelet lines 2 and 2*a* meet, is formed a center loop (not-designated) for use in the introduction of the tightening lace 4. With such a configuration, the tightening lace 4 is first threaded through the center loop so that it is centered thereon. On the basis of a center thereof, one-side portion of the tightening lace 4 is successively threaded upward through a plurality of the first row loops 3 arranged along the eyelet line 2, and the other-side portion of the tightening lace 4 is successively threaded upward through a plurality of the second row loops 3*a* arranged along the eyelet line 2*a*. In this case, both ends of the tightening lace 4, which remain after tying, are inserted through locking devices 5 and 5*a*. The locking devices 5 and 5*a* are fixed at opposite side positions above the eyelet lines 2 and 2*a*, respectively.

After completing the threading of the tightening lace 4, in the same manner as the tightening lace 4, a shoelace 6 is threaded through the center loop so that it is centered therein. On the basis of a center thereof, the shoelace 6 is tied to the tightening lace 4 as it alternately passes through portions of the tightening lace 4 between the respective first row loops 3, and portions of the tightening lace 4 between the respective second row loops 3*a* so as to crisscross each other. Both ends of the shoelace 6, which remain after tying, are tied into a bow-shaped knot.

Figure 3:
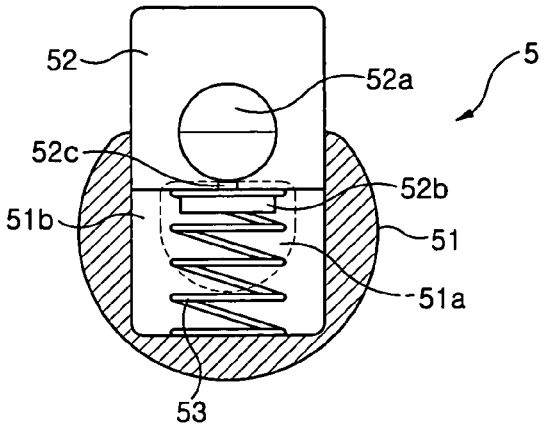
FIG. 3 is a sectional view illustrating a locking device of the shoelace tightening structure in accordance with the present invention.

Now, the configuration of the locking devices 5 and 5*a* will be explained in reference to FIG. 3. Since the locking devices 5 and 5*a* are identical to each other, only one of the locking devices 5 or 5*a* will be explained hereinafter as occasion demands.

The locking device 5 or 5*a* comprises a housing 51, a release button 52, and a spring 53. The housing 51 has a first through-opening 51*a* for use in the insertion of the tightening lace 4, and a second through-opening 51*b* for use in the insertion of the release button 52. The second through-opening 51*b* is perforated at one side of the first through-opening 51*a* in perpendicular thereto. The release button 52, which is configured to be inserted through the second through-opening 51*b* of the housing 51, is formed with a hole 52*a*. Through the hole 52 of the release button 52 is inserted the tightening lace 4, which is inserted through the first through-opening 51*a* of the housing 51. The release button 52 is further internally formed with a hollow protrusion 52*b* configured to allow one end of the spring 53 to be inserted and supported therein. In an inserted state, the spring 53 serves to offer elasticity to the release button 52 so that the release button 52 reciprocates inside the second through-opening 51*b*.

At opposite side positions of the outer peripheral surface below the hole 52*a*, the release button 52 is further symmetrically formed with a pair of prominent holders 52*c*. The holders 52*c* serve to prevent the release button 52 from being unintentionally separated from the second through-opening 51*b* during reciprocation thereof. At the inner peripheral surface of the second through-opening 51*b* are formed insertion recesses so that the holders 52*c* are inserted therein for the assembly of the release button 52 and the housing 51. The insertion recesses are equally spaced apart from a center axis of the first through-opening 51*b* by a predetermined angle.

Now, the operation and effects of the shoelace tightening structure of the present invention configured as stated above will be explained. First, in a state wherein the tightening lace 4 is centered on the center loop, one end of the tightening lace 4 successively passes through the first row loops 3 until the one-side portion of the tightening lace 4 is completely threaded upward through the first row loops 3. After that, the release button 52 of the locking device 5, which is fixed above the eyelet line 2, is pushed so that the hole 52*a* of the release button 52 coincides with the first through-opening 51*a* of the housing 51. Through these coincided first through-opening 51*a* and hole 52*a*, the end of the tightening lace 4 is inserted. In succession, the other end of the tightening lace 4 successively passes through the second row loops 3*a* until the other-side portion of the tightening lace 4 is completely threaded upward through the second row loops 3*a*. Then, as the other end of the tightening shoelace 4 is also inserted through the other locking device 5*a*, which is fixed above the eyelet line 2*a*, the tying of the tightening lace 4 is completed.

With such a structure, as the tightening lace 4 is pulled, the shoe is tightened to conform closely to the shape of the wearer's foot. On the contrary, when taking off the shoe, the release button 52 is pushed so as to release the tension of the tightening lace 4, thereby allowing the shoe to be loosened.

Alternatively, the tightening lace 4 may be tied as follows. In a state wherein one end of the tightening lace 4 is fixed by using the locking device 5, the other end of the tightening lace 4 is successively threaded through the first row loops 3 and the second row loops 3*a* arranged along the eyelet lines 2 and 2*a*, and then is inserted through the locking device 5*a*.

Even in this case, likewise, the shoelace 6 is tied on the tightening lace 4 as both ends thereof alternately pass through portions of the tightening lace 4 between the respective first row loops 3, and portions of the tightening lace 4 between the respective second row loops 3*a* so as to crisscross each other, and then are tied into a bow-shaped knot.

In case of tightening the shoelace 4, since the other end of the tightening lace 4 is fixed by the locking device 5*a*, the wearer can easily tighten the shoe 1 to conform closely with his/her foot by pulling one end of the tightening lace 4, which was inserted through the locking device 5.

As stated above, when taking off the shoe 1, the wearer can loosen the shoe by simply pushing the release buttons 52 of the locking devices 5 and 5*a* so that the tension of the shoelace 4 is sufficiently released to allow the wearer to take off the shoe 1. On the contrary, when putting on the shoe 1, the wearer can tighten the shoe to conform closely with the shape of his/her foot by pulling one end or both ends of the tightening lace 4. In this way, the wearer can conveniently tighten or loosen the shoe while securing an optimal wearing comfort, resulting in maximization in convenience of putting on or taking off the shoe.

As apparent from the above description, according to the shoelace tightening structure of the present invention, in a state wherein a tightening lace is tied and is appropriately tensioned by using locking devices, a shoelace of the shoe is tied thereon. With such a structure, when taking off the shoe, the wearer can easily loosen the shoe by simply pushing release buttons of the locking devices so as to release the tension of the tightening lace without requiring untying the shoelace tied on the tightening lace. On the contrary, when again putting on the shoe, the wearer can easily tighten the shoe to conform closely with his/her foot by simply pulling one end or both ends of the tightening lace. As a result, the present invention can maximize convenience in putting on or taking off the shoe.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A shoelace tightening structure comprising:

a tightening lace, which is successively threaded upward at both ends thereof through first and second row loops arranged in parallel along eyelet lines defined at left and right vamps of a shoe;

a pair of locking devices fixed at opposite side positions above the eyelet lines, through the locking devices being inserted both the ends of the tightening lace, respectively; and a shoelace, which is tied on the tightening lace as both ends thereof alternately pass through portions of the tightening lace between the respective first row loops, and portions of the tightening lace between the respective second row loops so as to crisscross each other.

* * * * *